US008387800B2

(12) United States Patent
Aman

(10) Patent No.: US 8,387,800 B2
(45) Date of Patent: Mar. 5, 2013

(54) SYSTEM AND METHOD TO IDENTIFY AND EXTRACT METALLIC ITEMS FROM IMPACTED SOIL TO ISOLATE ORDNANCE-RELATED ITEMS

(76) Inventor: Steven Mark Aman, Covina, CA (US)

( * ) Notice: Subject to any disclaimer, the term of this patent is extended or adjusted under 35 U.S.C. 154(b) by 681 days.

(21) Appl. No.: 11/866,362

(22) Filed: Oct. 2, 2007

(65) Prior Publication Data

US 2009/0084710 A1 Apr. 2, 2009

(51) Int. Cl.
*B03C 1/30* (2006.01)

(52) U.S. Cl. ..... 209/38; 209/218

(58) Field of Classification Search ..... 209/38, 209/213, 223.1, 251, 247, 257, 129, 44.4, 209/702–705, 942
See application file for complete search history.

(56) References Cited

U.S. PATENT DOCUMENTS

| | | | | |
|---|---|---|---|---|
| 5,992,774 | A * | 11/1999 | Oh | 241/20 |
| 6,279,748 | B1 * | 8/2001 | Nakamura et al. | 209/3 |
| 6,467,629 | B1 * | 10/2002 | Exner | 209/219 |
| 2005/0189263 | A1 * | 9/2005 | Wise | 209/223.1 |
| 2006/0070922 | A1 * | 4/2006 | LaVeine | 209/223.1 |
| 2008/0000813 | A1 * | 1/2008 | Wise | 209/223.1 |
| 2008/0251616 | A1 * | 10/2008 | Goldmann et al. | 241/24.14 |
| 2008/0314802 | A1 * | 12/2008 | Tuite | 209/38 |

OTHER PUBLICATIONS

Eriez, Suspended Electromagnets SE Series 7000 Brochure, SB-323N (2004).
Eriez, Eriez Metalarm Metal Detectors, Models TR, BR, PL, PL2, VC and SS Brochure, MD-180C (2001).

* cited by examiner

*Primary Examiner* — Joseph C Rodriguez
*Assistant Examiner* — Kalyanavenkateshware Kumar
(74) *Attorney, Agent, or Firm* — Blakely Sokoloff Taylor & Zafman, LLP

(57) ABSTRACT

A system and method to identify and extract metallic items from impacted soil to isolate ordnance-related items is disclosed. A feeder feeds impacted soil onto a first conveyor belt that conveys the impacted soil towards a screener. The screener screens particles from the impacted soil received from the first conveyor belt, and if the particles are smaller than an ordnance-related size of concern, the particles pass through the screener. If the particles are larger than the ordnance-related size of concern, the larger particles are passed onto a second conveyor belt. The second conveyor belt conveys the impacted soil towards a magnet positioned above the second conveyor belt. The magnet is utilized to pull metallic items away from the impacted soil for inspection by an ordnance inspector to determine if a metallic item is ordnance-related. Impacted soil is cycled back to the screener and the magnet in a closed-loop system.

10 Claims, 3 Drawing Sheets

SYSTEM AND METHOD TO IDENTIFY AND EXTRACT METALLIC ITEMS FROM IMPACTED SOIL TO ISOLATE ORDNANCE-RELATED ITEMS

FIELD OF THE INVENTION

The present invention relates to soil processing and separation of ordnance-related items from soil. More particularly, the present invention relates to systems and methods to identify and extract metallic items from impacted soil to isolate ordnance-related items

DESCRIPTION OF THE RELATED ART

Conventional techniques to remove ordnance-related items from collected soil have typically included mechanical means to segregate materials by particle size and to then extract metal items, including ordnance-related items, by manual labor including the use of metal detectors.

For example, such a typical mechanical system used in past types of operations typically includes a portable in-line construction screening system having a feeder/hopper in which soil with commingled metals (i.e., impacted soil) is inserted by earth-moving equipment and a conveyor belt connected thereto transports the materials upwards toward a vibrating screen that performs a minimal amount of soil separation. Materials which are small enough to pass through the screen's opening are considered clean.

The rest of the material having larger particle sizes (i.e., that do not fall through the screen) are moved onto another conveyor belt that extends outward from the plant at the opposite end of the hopper. Ordnance technicians are positioned at the sides of the belt and attempt to pick all of the metal items that they can visually detect from the soil. Unfortunately, metallic items including ordnance-related items and/or other munitions-related articles often go unnoticed by the technicians and are not removed.

Materials that continue along the conveyor belt past the ordnance technicians drop onto a pile at the belt's end. At this point, a process separate from mechanical screening is typically used in which ordnance technicians manually use metal detectors in an attempt to detect and remove items that were not initially extracted from the impacted soil traveling along the belt.

These prior techniques to remove ordnance-related items and other munitions-related material are unfortunately cumbersome, costly, and are subject to human error. Further, there is a low degree of assurance that metal items including ordnance-related and other munitions-related items will in fact be removed.

DETAILED DESCRIPTION

Figure 1:
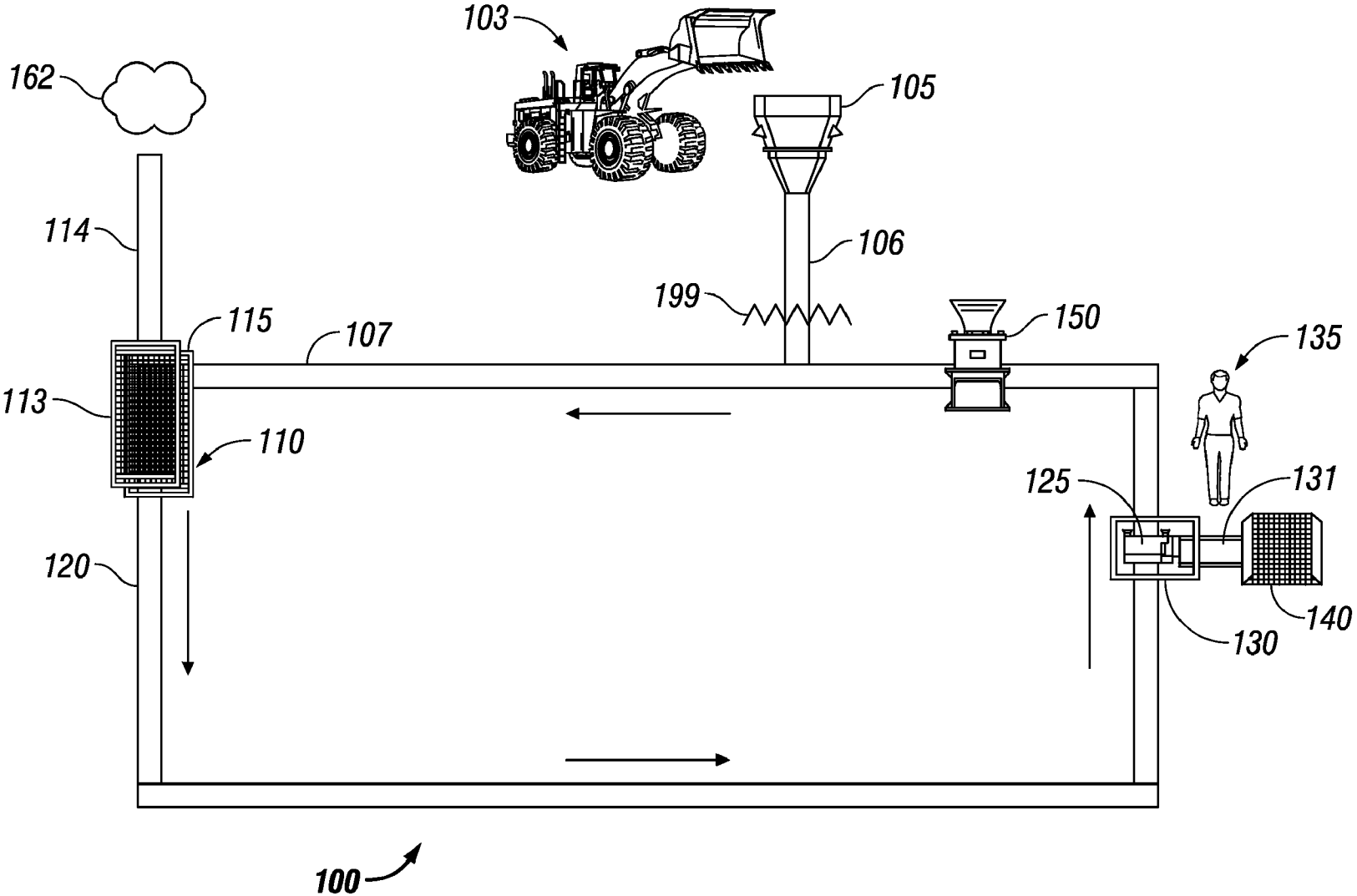
FIG. 1 is a diagram illustrating a system to identify and extract metallic items from impacted soil to isolate ordnance-related items, according to one embodiment of the invention.

In the following description, numerous specific details are set forth. However, it is understood that embodiments of the invention may be practiced without these specific details. In other instances, well-known mechanical structures, construction equipment, mining equipment, and associated techniques, have not been shown in order not to obscure the understanding of this description.

Embodiments of the invention relate to a system and method to safely identify and extract, in a comprehensive fashion, ordnance-related metallic items from impacted soil in order to isolate the ordnance-related metallic items. In particular, the ordnance-related metallic items relate to any and all munitions, fabricated using ferrous or non-ferrous metal, such as small arms rounds, artillery shells, grenades, rockets and missiles, bombs, mortars, mines, etc. For the purposes of the description contained herein, the term ordnance-related metallic items is extended to the components of such articles, as well. The metallic items of concern are typically identified by their size, shape, and other distinguishing features.

The systems and methods to be hereinafter described provide techniques for the comprehensive extraction of munitions-related metals from impacted soils that have typically been abandoned or discarded during past munitions operations. Munitions-related metals are removed systematically from the materials in which they are encapsulated by mechanical processes. These techniques are based on soil volume reduction, closed-loop screening, and conveyor processes to provide a means by which to contain all of the metallic items of a pre-determined minimum size until the metallic items can be safely extracted in a controlled manner. For example, if the smallest ordnance-related item of concern to be removed from soil happens to be an item that is ½ inch in the smallest dimension, the materials would be screened to less than ½ inch, or 7/16 inch. Any items larger than 7/16 inch would require inspection and removal if it is an ordnance-related item of concern.

In order to accomplish this, construction equipment is assembled in a configuration such that each equipment station is linked to, abuts, or is otherwise coupled to another equipment station in a closed-loop fashion. In this way, metallic items in excess of a specified size are not allowed to leave the system until they are extracted by a hand or magnet. Munitions-impacted soils may be introduced into the system by earth-moving equipment such as by depositing collected earth into a hopper/feeder. From there, the impacted soil may be transported through the system by conveyor belts.

At various junctures, the impacted soil may undergo size reduction to break down clay content or to break down other materials such as rock. The by-product of this is smaller soil particles and other smaller material particles separated from metallic items.

It should be appreciated that the collected impacted soil may include rocks, various degrees of clumped dirt and clay, metallic items, non-metallic items, and other materials. In general, the impacted soil that is processed will also be hereinafter generally described as "material". The components of this material may or may not be able to be downsized. In particular, the systems, techniques, and methods disclosed herein will be utilized to detect and remove metallic items, and even more particularly, metallic ordnance-related items. Reference will be made hereinafter to impacted soil and material interchangeably.

In particular, materials not downsized by equipment action may pass under industrial electromagnets that extract ferrous metallic items and deposit them onto a slow-moving conveyor belt where they may be examined by ordnance technicians or deposited into a container at the end of the slow-moving conveyor belt. Materials may continue through the system and may be repeatedly exposed to volume reduction and metal extraction processes until all the metallic items are removed and all soils and materials are reduced to a finished product size. Non-metallic items in excess of an ordnance-related size of concern will continue their movement in the closed-loop process until they are extracted from the system manually and inspected for ordnance.

Turning to FIG. 1, FIG. 1 is a diagram illustrating a system 100 (sometimes referred to as a plant) to identify and extract metallic items from impacted soil to isolate ordnance-related items, according to one embodiment of the invention. As previously described, the impacted soil may include metallic items and various other material.

In particular, system 100 includes a hopper/feeder 105 to feed impacted soil onto a first conveyor belt 106 which then transfers the material to conveyor 107 that conveys the impacted soil in a first direction towards a screener 110. Screener 110 screens particles from the impacted soil received from the first conveyor belt 107, and if the particles are smaller than an ordnance-related size of concern, the particles pass through screener 110 and are deposited into a "clean" pile 162.

On the other hand, if the particles are larger than the ordnance-related size of concern, the larger particles are passed onto a second conveyor belt 120. Second conveyor belt 120 conveys the larger particles of impacted soil in a second direction towards a magnet 125 positioned above the second conveyor belt. Magnet 125 is utilized to pull metallic items away from the impacted soil for inspection by an ordnance technician to determine if a metallic item is ordnance-related. The impacted soil is then cycled back towards screener 110 and again towards magnet 125 in a closed-loop system.

System 100 employs standard construction, manufacturing, and mining equipment to confine impacted soil and metallic items introduced into the system until all metallic items, including those that are munitions-related are extracted and removed. Further, a soil size reducer 150 may be located between the magnet 125 and feeder 105 and may be utilized to reduce the size of the impacted soil by producing a larger number of smaller-sized particles from the impacted soil.

System 100 utilizes both soil screening and volume reduction techniques to remove metallic items, such as ordnance-related items. In particular, system 100 allows for commingled metallic items to be extracted by the magnetic force of magnet 125 or by visual inspection depending upon the types of metallic item. Thus, system 100 and the techniques employed herein include: soil volume reduction, screening, extraction, and removal of commingled metallic items.

Looking more particularly at system 100, earth-moving equipment such as a loader/excavator 103 may be utilized to deposit impacted soil having suspected metallic ordnance items into hopper/feeder 105 at a first station in system 100.

Hoppers/feeder equipment is well known in the construction and mining industries. Typically, a hopper/feeder, such as hopper/feeder 105, resembles a large rectangular vat. Generally, a hopper/feeder includes a large steel container with a wide opening at its top end and it generally narrows towards its bottom. Hopper/feeder 105 is designed to receive materials into its top end opening (from loader/excavator 103) and it allows materials to filter down like a funnel onto a receiving conveyor belt 106.

Receiving conveyor belt 106 is located at the bottom of hopper/feeder 105. Conveyor belt 106 is motor-driven and its belt moves on rollers in continuing revolutions around the rollers. The belt of conveyor belt 106 receives materials in a smooth, uniform manner. Motor driven conveyor belts are well known in the art and the description thereof will not be given for brevity's sake. The other conveyor belts also operate in similar fashion.

Further, in some embodiments, hopper/feeder 105 may include a grizzly (not shown), if it is anticipated that large debris articles may be commingled in the impacted soil to be screened. As is known, a grizzly is a grate-like assembly constructed of square steel channeling or tube-like bars that are parallel to one another and are spaced apart from one another segregate out large oversize materials, typically greater than 6 inches in size.

Also, shielding (not shown) may be configured around hopper/feeder 105 and other areas depending on the safety concerns and to protect against possible blast and fragmentation in the event of a detonation of a live munitions item within hopper/feeder 105. The thickness of the shielding may be based upon data obtained from US Army Engineering and Support Center, Huntsville, Center of Expertise for Ordnance and Explosives, based upon the agencies past test data for the munitions of concern.

The impacted soil moves out of hopper/feeder 105 along belt 106 at the bottom of the hopper/feeder and transfers onto a first wide conveyor belt 107 angled upwards to convey the materials to screener 110. As previously described, screener 110 is utilized to screen particles from the impacted soil received from the first conveyor belt. By utilizing screener 110, particles that are smaller than an ordnance-related size of concern pass through the screener into a clean pile 162 away from the plant, as previously described, whereas particles that are larger than the ordnance-related size of concern are passed on to second conveyor belt 120.

In this embodiment, a two-deck screen is illustrated. Vibrating screener 110 is used to screen particles from the impacted soil and, if the particles are smaller than an ordnance-related size of concern, the particles pass through the screener and into a clean pile 162 away from the plant, whereas if the particles are larger than an ordnance-related size of concern, the larger particles are passed through system 100.

In particular, vibrating screener 110 includes a scalping deck screener 113 which is a heavy gauge, larger-size screen (e.g., 3 inch grating openings) to reduce the impact of larger size rocks to the second bottom screen 115. Thus, the two different screens 113 and 115 each have a different grating size. The size of openings in the 113 screen grates will be determined based on the smallest dimension of the metallic item(s) required to be removed from the impacted soils at a particular project site. Materials less than a specified grating of the top screen 113 fall onto the vibrating second screen 115. Materials less than a specified target grating size of screen 115 further fall through the second screen 115 and fall onto a conveyor belt 114 and are transferred either to a clean pile 162 or otherwise away from the plant. In either case, the material is considered clean.

Materials that do not fall through vibrating second screen 115 are transferred through a chute (not shown) onto conveyor belt 120. The grating size of the second screen 115 is less than the ordnance-related size of concern of the metallic items to be captured. Additionally, materials that are too large to pass through the gratings of the first vibrating screen 113 likewise are transferred through a chute (not shown) and are deposited onto second conveyor belt 120 and continue to be processed within the closed loop system.

Vibrating screener 110 aids in the volume reduction of material to help ensure that metallic items, including ordnance-related metallic items, will be removed by reducing total materials volume to a level where such recovery actions are possible. Metallic items will be less likely to remain encapsulated by thick volumes of soil by the actions of vibrating screener 110. The vibrating screens vibrate vigorously so that materials on the screen separate and items smaller than the screen's gratings pass through them. Thus, this activity creates a sifting effect.

Although vibrating screener 110 has been described as having two screens it may have three or more screens, or it may be of other configurations, that are known to those of skill in the art. For example, vibrating screener 110 may have a three screen configuration, as does screener 310, which will be discussed with reference to FIG. 2.

The materials that do not filter through the screens 113 and 115 are placed via a chute (not shown) onto second conveyor belt 120 such that the potentially impacted soil is conveyed towards magnet 125 positioned above second conveyor belt 120. Magnet 125 is utilized to pull metallic items away from the impacted soil for inspection by an ordnance technician to determine if a metallic item is ordnance-related In one embodiment, magnet 125 is a electromagnetic belt magnet. Electromagnetic belt magnets are well known in the art. For example, in one embodiment, electromagnetic belt magnet 125 may be an ERIEZ SE Series 7000 suspended electromagnetic belt magnet.

As materials travel under electromagnet belt magnet 125, metallic items are attracted to the magnetic belt and then deposited onto another slow-moving conveyor belt 131 and are conveyed to a storage bin 140. Metallic items may be inspected by one or more ordnance technicians 135 continuously as they move along conveyer belt 131. Further, metallic items are deposited in bin 140 and may later be inspected by ordnance technicians. For example, at the end of a work shift ordnance technicians may look through the bin for ordnance-related items.

Additionally, a barrier, such as a one-inch thick steel plate, may be placed around magnet 125 in a suitable configuration in order to protect ordnance technician(s) 135 from unintentionally exploded ordnance. The thickness and design may be in accordance with U.S. Army Engineering Standards (previously discussed).

Materials passing under magnet 125 are conveyed back towards feeder 105 and back onto first conveyor belt 107 such that the process is repeated again.

In one embodiment, a soil size reducer 150 may be placed along first conveyor belt 107 before feeder 105. Soil size reducer 150 may be utilized to produce a larger number of smaller-sized particles from the impacted soil. In particular, materials may be further reduced or broken down by being run through soil size reducer 150. Soil size reducers are well known in the art.

In particular, different types of soil size reducers may be used such as a cone crusher, a hammer mill, or an impact crusher for size reduction. The type of soil size reducer may be chosen dependent upon the type of earth/soil that is being reduced. After this operation, the reduced soil is conveyed via first conveyor belt 107 back to the screener 110 and the process for the materials begins again. In this way a closed-loop process is achieved. It should be appreciated that by utilizing a soil size reducer 105 rocks and non-metallic materials are reduced in size so that they can be passed through screener 110 as clean material.

It should be noted that although any suitable type of soil size reducer 150 may be utilized such as a cone crusher or an impact crusher, that the hammer mill type of crusher has been found to be especially well-suited for breaking down oversize materials contained in impacted soil with ordnance-related materials.

As is known, in a hammer mill, hammers are free spinning while suspended from rods that are attached to a spindle-like drum and the hammers are spun at a very fast rate, such as 1600 revolutions per minute. A crusher plate may also be bolted onto the chamber wall to enhance the material clod-reducing action. Materials entering a hammer mill are exposed to the hammers' poundings and are crushed between the hammers and the crushing plate before falling back onto the conveyor belt. The hammer mill effectively breaks down many soil clods and potential munitions items that are trapped in the clods are freed from their clod encapsulation and exposed such that they are more readily to be attracted and expelled by magnet 125. Additionally, the broken up soil clods are turned into finer grade soils and/or rocks that may be more readily screened through the decked vibrating screener 110.

Again, materials that are larger than the grating sizes of the screener 110 are rejected by the top and bottom screens 113 and 115 and are diverted down a chute back on to the second conveyor belt 120 to again be passed under suspended electromagnetic belt magnetic 125.

Looking at electromagnetic belt magnet 125 more particularly, in one embodiment, electromagnetic belt magnet 125 may be suspended over conveyor belt 120 by a steel I-beam frame. In the electromagnetic belt magnet example, magnetic plates are attached to a belt and spin with the belt wherein the belt of the magnet is suspended over the conveyor belt and is perpendicular thereto. In one example, the belt's width and length may be approximately five feet. The magnetic plates may be spaced approximately one foot apart from one another along the belt and spin with the belt around drums affixed within the housing of the magnet at a high rate of speed. These sorts of electromagnetic belt magnet are well known in the art. An example of such an electromagnetic belt magnet is the ERIEZ SE Series 7000.

Electric power is supplied to the plates and quickly withdrawn in timed intervals in a pulsing action. Metallic items, and particularly, ordnance-related metallic items that are commingled in soil, will, in practically every case, be attracted to the electrically-charged plates that spin over head. After being attracted to the magnets, metallic items are expelled onto a slow-moving conveyor belt 131 positioned parallel to and butted against and directly under the belt of the belt magnet suspended above.

Materials passing under magnet 125 will be exposed to its full magnetic attraction properties for approximately 2 to 3 seconds. The metallic items that are not attracted to the magnetic plates during their first pass under magnet 125 may be too deep within the soils to be affected by the magnet's pull. However, it is inevitable that these metallic items will be eventually removed during subsequent passes under magnet 125. This is made possible by the closed-loop system which ensures that the metallic items remain in the plant's system until soil volume reduction occurs via soil size reducer 150 enough to allow the metallic item's adequate exposure to the pulling action from magnet 125. Thus, metallic items eventually work their way closer to the top of the pile of soil in which they are commingled.

Additionally, as previously described, one or more ordnance technicians 135 may be positioned on the sides of the slow-moving conveyor belt 131 where the metallic items extracted by the magnet are deposited onto. This station within system 100 is typically known, or referred to within the art to which this system is commonly associated with, as the "pick line."

As previously described, a barrier 130 may be constructed that straddles the slow-moving conveyor belt 131. Barrier 130 may be, for example, a one-inch thick or greater steel plate that surrounds magnet 125 to provide protection for the ordnance technicians. It separates the ordnance technicians from magnet 125 to protect the technicians if an ordnance round detonates while being extracted by the magnet. The thickness and design may be in accordance with U.S. Army Engineering Standards (previously discussed). Additional safety barriers may be established at various locations of the plant equipment depending on the site conditions.

As the metallic items move along the slow-moving conveyor belt 131, the ordnance technicians may remove and visually inspect each item. Metallic items that are suspect ordnance may be segregated from obvious scrap metal that may be allowed to enter waste bin 140 at the end of the slow-moving belt 131.

Other non-metallic materials or non-ferrous metals will not be extracted by magnet 125 due to their non-magnetic properties, and instead bypass the magnet and, as previously described, continue traveling along the conveyor belts commingled with soils. Non-ferrous metals and other materials may be recovered periodically by stopping the feeding of system 100 at feeder 105, and letting those materials already in the system recycle several revolutions through the system.

After several revolutions, practically all of the soils that were within system 100 prior to halting the plant's feeding will have undergone a complete volume reduction by vibrating screener 110 and soil size reducer 150. In essence, materials will have been downsized enough to pass through the screens and will be deposited in clean pile 162. The materials remaining, including non-metallic items and non-ferrous metals that are not within the ordnance-related size of concern of vibrating screener 110 will accumulate in piles on the conveyor belts. The plant operator can stop the system 100 and the non-metallic and non-ferrous materials may be safely removed by hand or may be removed from the system by intercepting them at one of the drop points using a loader bucket, after which they can be inspected for ordnance-related items. Another option to removing non-ferrous metals from the system would be to incorporate a ERIEZ rare-earth magnet which would remove non-ferrous items in the same fashion as magnet 125.

It should be appreciated that materials not removed during previous downsizing activities, including soils and metallic items commingled in soils that are not within the ordnance-related size of concern specifications of screener 110, will continuously recycle through system 100 until they have either been reduced to a size less than the ordnance-related size of concern of the screener 110, allowing them to become finished product, or, if they are metallic items, to be extracted by magnet 125 and to be removed by hand at the "pick-line". The closed-loop configuration facilitates this repetitive action. During this recycling, material volume reduction will repeatedly occur to allow for the removal of metallic items, including munitions that are not within specification.

Additionally, to enhance the removal process, a plant's superintendent may regulate the flow of material being fed into the plant by hopper/feeder 105 and loader 103. The superintendent may watch the thickness of the materials traveling along conveyor belts 107 and 120. For example, soils may be considered to be too deep on a conveyor belt when the superintendent observes that they are approaching the top edges of the conveyor belt. Whenever this situation occurs, the superintendent may direct the operator of the earth-moving equipment introducing impacted material into the plant at hopper/feeder 105 to decrease the rate at which the plant is being fed. If necessary, the operator may stop feeding the plant to allow the materials to undergo volume reduction by soil size reducer 150 and by vibrating screener 110 until the soil's depth drops below the top edges of the belts.

Figure 2:
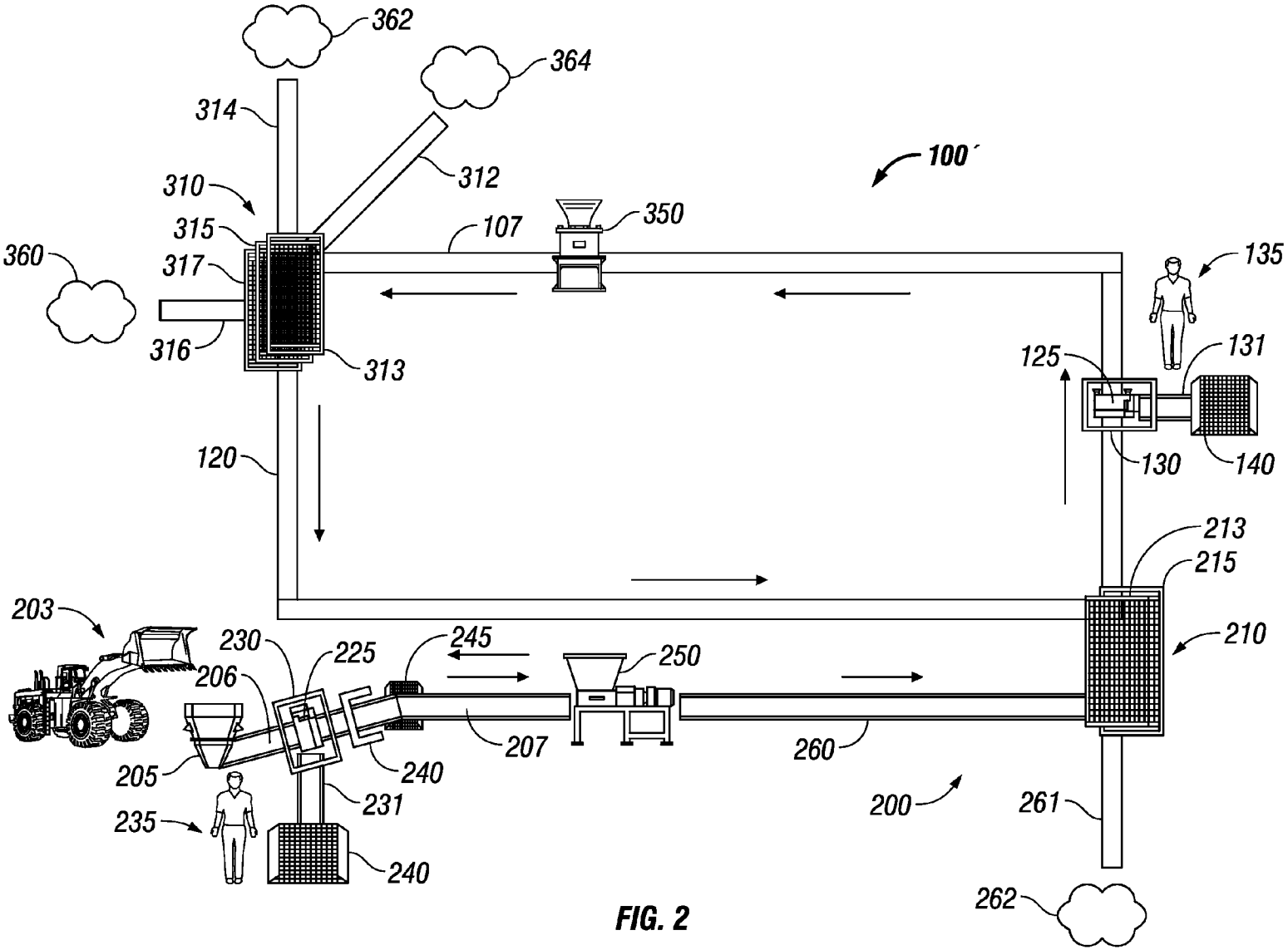
FIG. 2 is a diagram illustrating another embodiment of a system to identify and extract metallic items from impacted soil to isolate ordnance-related items.

Turning now to FIG. 2, FIG. 2 is a diagram illustrating another embodiment of a system 200 to identify and extract metallic items from impacted soil to isolate ordnance-related items. As previously described, the impacted soil may include metallic items and various other materials. In particular, the embodiment exemplified in FIG. 2 is a system 200 that incorporates most of the components of the previously-described system 100 (shown as 100') and further includes a safety feature and is geared towards soil that contains larger portions of rocks and other materials that may need additional downsizing by crushing action/means. Further, system 200 also provides for the collection of aggregate material, as will be described.

As shown in FIG. 2, system 200 includes earth-moving equipment such as a loader/excavator 203 to deposit impacted soil having suspect metal ordnance items into a hopper/feeder 205. Hopper/feeder 205 is similar to previously-described hopper/feeder 105. A motor/driven conveyor belt 206 is located at the bottom of hopper/feeder 205. As previously described, hopper/feeder 205 may include a grizzly to further reduce the volume size of the materials.

Materials pass under electromagnetic belt magnet 225 along conveyor belt 206. Electromagnetic belt magnet 225 is suspended above conveyor belt 206. Electromagnetic belt magnet 225 is similar in design and placement as previously-described electromagnetic belt magnet 125. Magnet 225 is utilized to remove larger items of metallic materials which may be ordnance-related items. As with the previously-described magnet 125, magnet 225 picks up the metallic items and places them on a slow moving conveyor 231. An ordnance technician 235 may remove any identified metallic items of concern. Other metal materials may accumulate in a waste bin 240 at the end of conveyor 231.

Further, as previously described, a barrier 230, such as a one-inch thick, or thicker, steel plate may surround magnet 225 (as with magnet 125) to provide protection for the ordnance technician.

The design and operations of magnet 225, barrier 230, etc., conveyor belt 231, and this "pick-line" in general, is similar to the previously-described magnet 125 and "pick-line" previously-described in the discussion of FIG. 1.

Materials passing under magnet 225 along conveyor belt 206 are next passed under a metal detector 240. The metal detectors sensitivity level can be pre-set to detect metallic items at a pre-determined size specification. If a metallic item (ferrous or non-ferrous), over a pre-set size is detected by metal detector 240, it triggers a switch so that the feeder/hopper 205 is automatically shut down and at the same time it triggers a switch on a timer to conveyor belt 206 and 207 so that both conveyors will continue to move to the point where the detected item will drop from conveyor 206 onto conveyor belt 207 located under conveyor belt 206 and then both conveyor belt 206 and 207 both stop at the same time.

Conveyor belt 207 in sequence automatically reverses itself a short distance such that the detected metallic item is then dumped into a container 245 for inspection. Typically, conveyor belt 207 operates in a forward direction and in the same direction as conveyor belt 206. Conveyor belt 206, conveyor belt 207, and feeder/hopper 205 then automatically restart in the forward direction after the metallic item has been dropped into container 245 which will be cushioned with foam rubber material to avoid major impact. All of the other plant components will continue to operate without interruption during this sequence.

Many types of conventional metal detectors may be used for this purpose. For example, ERIEZ METALARM metal detectors may be utilized.

In this way a safety feature is provided in that a large metallic item that is too heavy to be picked up or not picked up by magnet 225 is detected by metal detector 240 and removed from system 200 before further processing. This may be beneficial in that a large ordnance-related item may be present that could detonate during further volume reduction.

Additionally, this safety feature mechanism that includes an additional magnet 225 and "pick-line" in combination with a metal detector 240 and an additional reversible conveyor belt and container to detect and remove large metallic items before they are introduced into the system may also be utilized in system 100 of FIG. 1. For example, this safety feature mechanism may be located at position 199 of system 100, or at other locations. In this way, this safety feature may be incorporated into system 100.

Returning to system 200, next, conveyor belt 207 conveys the material to a soil size reducer 250. As with soil size reducer 150, soil size reducer 250 may be utilized to produce a larger number of smaller-sized particles from the impacted soil. Soil size reducers are well known in the art.

In this embodiment, soil size reducer 250 may be of a jaw crusher type. Jaw crushers are typically used to break oversized rocks into smaller more manageable particles. Jaw crushers are likewise well known in the art.

After jaw crushing, the materials are placed onto another conveyor belt 260 and are conveyed thereby to a vibrating screener 210. Vibrating screener 210 may be similar to the previously-described vibrating screener 110 and may include a two or three deck screen.

In this embodiment, a two-deck screen is illustrated. Similar to the previously-described vibrating screener 110, vibrating screener 210 is used to screen particles from the impacted soil and, if the particles are smaller than an ordnance-related size of concern, the particles pass through the screener 210 and into a clean pile 262 away from the plant, as previously described, whereas if the particles are larger than an ordnance-related size of concern, the larger particles are passed onto system 100'.

In particular, vibrating screener 210 includes a scalping deck screener 213 which is a heavy gauge, larger size screen (typically 3 inch openings) to reduce the impact of larger size rocks to the second bottom screen 215. The two different screens 213 and 215 each have a different grating size. The size of openings in the 213 screen grates will be determined based on the smallest dimension of the metallic item(s) required to be removed from the impacted soils at a particular project site. Materials less than a specified grating size of the top screen 213 fall onto the vibrating second screen 215. Materials less than a specified target grating size of screen 215 further fall through the second screen 215 and fall onto a conveyor belt 261 and are transferred either to a clean pile 262 or away from the plant, as previously described. In either case, the material is considered clean.

Materials that do not fall through vibrating second screen 215 are transferred through a chute (not shown) onto a conveyor belt 120. The grating size of the second screen 215 is less than the ordnance-related size of concern of the metallic items to be captured. Additionally, materials that are too large to pass through the gratings of the first vibrating screen 213 are transferred through a chute (not shown) and are also deposited onto second conveyor belt 120 of the previously-described system 100' and continue to be processed within the closed loop system.

Vibrating screener 210 aids in the volume reduction of material to help ensure that metallic items, including ordnance-related metallic items, will be removed by reducing total materials volume to a level where such recovery actions are possible. Metallic items will be less likely to remain encapsulated by thick volumes of soil by the actions of vibrating screener 210. The vibrating screens vibrate vigorously so that materials on the screen separate and items smaller than the screen's gratings pass through them. Thus, this activity creates a sifting effect.

Although vibrating screener 210 has been described as having two screens it may have three screens, or it may be of other configurations, that are known to those of skill in the art.

Also, it should be noted that the screen gratings of vibrating screener 210 for screens 213 and 215 may be larger than the screen grating sizes of vibrating screener 310, to be described. Alternatively, they may be of the same grating size.

In any event, material loaded onto the second conveyor belt 120 of system 100' then proceeds in almost the exact same fashion as closed-loop system 100, described with reference to FIG. 1, to perform soil volume size reduction and metallic item removal, previously described in detail. The only difference being that material is loaded at a different point in the system via hopper/feeder 205 instead of hopper/feeder 105 and the materials enter system 100' right before magnet 125. Also, in this embodiment, previously-described additional jaw crusher 250 allows for the volume reduction of soils that may have larger rocks and other materials, and additionally this embodiment includes the previously-described safety feature.

However, in this embodiment, instead of a two-deck screener as in system 100, system 100' utilizes a three-decked vibrating screener 310. In this embodiment, three different screens 313, 315, and 317 are utilized each having a different grating size. Impacted soils first vibrate upon the top screen 113. Materials less than the specified target grating size of the top screen 313 fall onto the second vibrating screen 315 having a smaller target grating size. Materials smaller than the grating size of second screen 315 lastly fall onto a third vibrating screen 317.

Materials that fall through the smallest target grating size of third vibrating screen 317 fall onto a conveyor belt 316 and are conveyed to a location and deposited to create a finished-product, or "clean" pile 360. Materials that are not small enough to fall through screen 317 are vibrated off screen 317 through a chute (not shown) and onto conveyor belt 314 and are conveyed away from the plant to clean pile 362. Materials that are too large to fall through vibrating screen 315 are vibrated off screen 315 through a chute (not shown) and onto a conveyor belt 312 and are conveyed away from the plant to clean pile 364. The processed materials/soil in these locations 360, 362, and 364 are considered clean material and free of ordnance materials and may be used for aggregate materials. Oftentimes, this aggregate material consists of small rocks.

However, materials that are too large to pass though the specified target grating of first vibrating screen 313 are vibrated off screen 313 through a chute (not shown) and onto second conveyor belt 120 for further processing.

It should be appreciated that the screens and the screens target grating sizes may be picked based upon soil and ordnance considerations. For example, screen sizes of 1 inch, ¾ inch, and ½ inch, may be typical screen sizes. If separation of materials for aggregate recovery is not desired, all of the materials less than the size of the bottom screen may be transferred to stockpile 360, and all other materials greater than the size of the bottom screen may be placed onto conveyor belt 120. In this case, clean stockpiles 362 and 364 and conveyors 312 and 314 would be eliminated.

Vibrating screener 310 also aids in volume reduction to help ensure that metallic items including ordnance-related metallic items will be removed by reducing total materials volume to a level where such recovery actions are possible. Metallic items will be less likely to remain encapsulated by thick volumes of soil after being vibrated by vibrating screener 310. The vibrating screens vibrate vigorously so that some materials on the screen separate from others and items smaller than the screen's openings pass through them. Thus, this activity creates a sifting effect. Vibrations cause materials within the screen grating size specification to fall through the larger openings of the top screen and onto the screens below it having an opening smaller than those of the top screen. Thus, top screen 313 serves as a retainer screen.

Larger materials and items that do not fall through the vibrating top screen 313 fall down a chute (not shown) onto second conveyor belt 120 and second conveyor belt 120 conveys the impacted soil, materials, for further processing.

It should be noted that target grating size of top screen 313 is determined based upon the size of the object that might be an ordnance item to be removed in a controlled manner. This will be typically the size or measurement of the smallest dimension of the ordnance-related item that is desired to be extracted by this process. The smaller materials extracted from screens 315 and 317 may be conveyed along separate conveyor belts in tandem away from the plant, as previously described.

Figure 3:
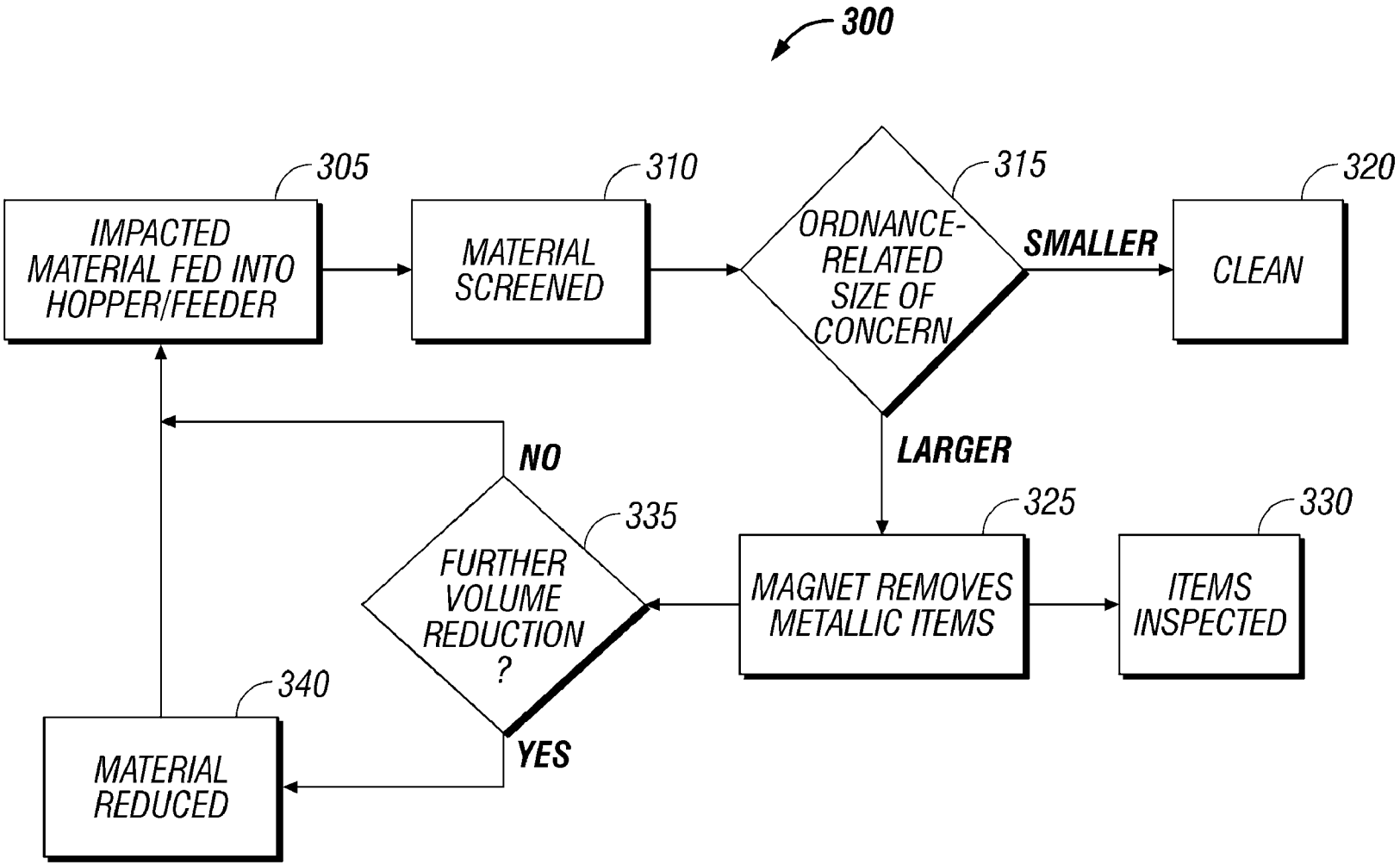
FIG. 3 is a flow diagram illustrating a process to identify and remove ordnance-related metallic items in a closed loop fashion, according to one embodiment of the invention

FIG. 3 is a flow diagram illustrating a process 300 to identify and remove ordnance-related metallic items in a closed-loop plant configuration.

At block 305, impacted material is fed into a hopper/feeder. In particular, as previously described, munitions-impacted soils may be introduced into a closed-loop system by earth-moving equipment by depositing them into the hopper/feeder. At various junctures within process 300, materials are screened and/or undergo size reduction.

At block 310, material is screened. At block 315, it is determined whether the material is below a certain ordnance-related size of concern. If it is, then at block 320, the material is considered clean.

However, if the material is larger than the ordnance-related size of concern, the material may be subject to a magnet (block 325) to remove and extract metallic items from the impacted soil and the metallic items can then be inspected (block 330).

Further volume reduction (bock 335) may be applied dependent upon the design characteristics of the system or if sized aggregate is being produced as part of the operation (block 335). If so, at block 340, the material is further reduced by a soil volume reducer such as by the use of a hammer mill, a cone crusher, or an impact crusher. In either event, the material is fed back into the system and again goes through the previously-described screening process 300. In this way, a closed-loop system is provided.

It should be appreciated by those with skill in this art that, although embodiments of the invention have been previously described with reference to particular structural implementations such as utilizing conveyor belts, vibrating screens, electromagnetic belt magnets, soil size reducers, etc., that embodiments of the invention may be utilized with a wide variety of different types of structural implementations utilizing a wide variety of different types of mining, construction and manufacturing equipment

What is claimed is:

1. A system to identify and extract metallic items from impacted soil to isolate ordnance-related items from the impacted soil including metallic items and other material for inspection by an ordnance technician, the system comprising:

a feeder to feed impacted soil onto a first conveyor belt that conveys the impacted soil in a first direction;

a screener to separate metal particles from the impacted soil received from the first conveyor belt, wherein if the particles are smaller than an ordnance-related size of concern, the particles pass through the screener and are deposited into a clean pile, whereas if the particles are larger than the ordnance-related size of concern, the larger particles are passed onto a second conveyor belt, the second conveyor belt to convey the larger particles of impacted soil in a second direction;

a electromagnetic belt magnet positioned above the second conveyor belt, the electromagnetic belt magnet to pull metallic items away from the impacted soil for inspection to determine if a metallic item is ordnance related;

a pick-line including a conveyor belt, wherein the electromagnetic belt magnet deposits metallic items onto the conveyor belt such that the ordnance technician is capable of inspecting metallic items to determine if a metallic item is ordnance-related, wherein the impacted soil is cycled back to the screener; and a plate barrier straddling the pick-line to protect the ordnance technician from ordnance detonation at the electromagnetic belt magnet.

2. The system of claim 1, further comprising a soil size reducer located between the magnet and the feeder, the soil size reducer to produce a larger number of smaller-sized particles from the larger particles of impacted soil.

3. The system of claim 2, wherein the soil size reducer is one of a cone crusher, impact crusher, and a hammer mill.

4. The system of claim 1, further comprising a metal detector to detect a metallic item over a pre-set size.

5. The system of claim 4, further comprising a reversible conveyor belt and a container, wherein, if the metal detector detects a metallic item over a pre-set size, the reversible conveyor belt is reversed such that the metallic item is deposited into the container.

6. A system to identify and extract metallic items from impacted soil to isolate ordnance-related items, the impacted soil including metallic items and other material for inspection by an ordnance technician, the system comprising:

a feeder to feed impacted soil onto a first conveyor belt that conveys the impacted soil in a first direction;

a screener to screen particles from the impacted soil received from the first conveyor belt, wherein if the particles are smaller than a ordnance-related size of concern, the particles pass through the screener and are deposited into a clean pile, whereas if the particles are larger than the ordnance-related size of concern, the larger particles are passed onto a second conveyor belt, the second conveyor belt to convey the larger particles of impacted soil in a second direction;

an electromagnetic belt magnet having a rotary magnetic belt positioned above the second conveyor belt, the electromagnetic belt magnet to pull metallic items away from the larger particles;

a pick-line including a conveyor belt, wherein the electromagnetic belt magnet deposits metallic items onto the conveyor belt such that the ordinance technician is capable of inspecting a metallic item to determine if the metallic item is ordnance related; and a plate barrier straddling the pick-line to protect the ordnance technician from ordnance detonation at the electromagnetic belt magnet;

wherein the impacted soil is cycled back to the screener and the magnet in a closed-loop.

7. The system of claim 6, further comprising a soil size reducer located between the electromagnetic belt magnet and the feeder, the soil size reducer to produce a larger number of smaller-sized particles from the larger particles of impacted soil.

8. The system of claim 7, wherein the soil size reducer is one of a cone crusher, impact crusher, and a hammer mill.

9. The system of claim 6, further comprising a metal detector to detect a metallic item over a pre-set size.

10. The system of claim 9, further comprising a reversible conveyor belt and a container, wherein, if the metal detector detects a metallic item over a pre-set size, the reversible conveyor belt is reversed such that the metallic item is deposited into the container.

* * * * *